US009248487B2

(12) United States Patent
Daimaru

(10) Patent No.: US 9,248,487 B2
(45) Date of Patent: Feb. 2, 2016

(54) FORMING METHOD OF METAL MEMBER EXCELLENT IN SHAPE FREEZING PROPERTY

(75) Inventor: Seiichi Daimaru, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 323 days.

(21) Appl. No.: 13/697,918

(22) PCT Filed: May 23, 2011

(86) PCT No.: PCT/JP2011/061720

§ 371 (c)(1),
(2), (4) Date: Dec. 21, 2012

(87) PCT Pub. No.: WO2011/148880

PCT Pub. Date: Dec. 1, 2011

(65) Prior Publication Data

US 2013/0104618 A1 May 2, 2013

(30) Foreign Application Priority Data

May 25, 2010 (JP) ..... 2010-119158

(51) Int. Cl.
*B21D 22/00* (2006.01)
*B21D 22/16* (2006.01)
(Continued)

(52) U.S. Cl.
CPC ..... *B21D 22/00* (2013.01); *B21D 22/02* (2013.01); *B21D 22/26* (2013.01); *B21D 37/10* (2013.01)

(58) Field of Classification Search
CPC ..... B21D 22/26; B21D 22/02; B21D 35/00; B21D 37/16; B21D 22/022; B21D 22/208; B21D 11/10; B21D 11/20; B21J 5/06
USPC ..... 72/347, 702, 348, 379.2, 380, 386
See application file for complete search history.

(56) References Cited

U.S. PATENT DOCUMENTS 6,293,134 B1 * 9/2001 Johnson ..... 72/335
6,675,626 B2 * 1/2004 Arai ..... 72/379.2
(Continued)

FOREIGN PATENT DOCUMENTS

JP 06-246355 9/1994
JP 2004-181502 7/2004
(Continued)

OTHER PUBLICATIONS

International Search Report dated Aug. 2, 2011, issued in corresponding PCT Application No. PCT/JP2011/061720.
(Continued)

*Primary Examiner* — Peter DungBa Vo
*Assistant Examiner* — John S Lowe
(74) *Attorney, Agent, or Firm* — Kenyon & Kenyon LLP

(57) ABSTRACT

When forming a hat-shaped cross section member having, on its cross section perpendicular to its longitudinal direction, vertical wall portions on both sides, and flange portions on both sides connected to the respective vertical wall portions, and a top sheet portion connected to the vertical wall portions on both sides, and having a bent portion bent in the longitudinal direction with the flange portions positioned outside by using punches and dices, a dice shoulder radius of the dice for obtaining the shape of the hat-shaped cross section member is set to $R_0$, the hat-shaped cross section member is formed by the dice having a dice shoulder radius $R_1$ larger than the dice shoulder radius $R_0$, and then the hat-shaped cross section member is formed by the dice having the dice shoulder radius $R_0$.

3 Claims, 6 Drawing Sheets

(51) Int. Cl.

| | |
|---|---|
| ***B21D 22/02*** | (2006.01) |
| ***B21D 37/10*** | (2006.01) |
| ***B21D 22/26*** | (2006.01) |

(56) References Cited

U.S. PATENT DOCUMENTS

| | | | | |
|---|---|---|---|---|
| 7,117,708 | B2 * | 10/2006 | Yamano et al. | 72/350 |
| 2012/0204619 | A1 * | 8/2012 | Maeda et al. | 72/379.2 |

FOREIGN PATENT DOCUMENTS

| | | | |
|---|---|---|---|
| JP | 2004-337980 | | 12/2004 |
| JP | 2007-021568 | | 2/2007 |
| JP | 2007021568 | A * | 2/2007 |
| JP | 2007-111725 | | 5/2007 |
| JP | 2008-221289 | | 9/2008 |
| JP | 2010-064139 | | 3/2010 |

OTHER PUBLICATIONS

International Preliminary Report on Patentability dated Dec. 20, 2012 issued in corresponding PCT Application No. PCT/JP2011/061720.

Examination Report of Jan. 23, 2015 in corresponding Australian application No. 2011259044.

Smith, D., 'Die Design Handbook', Society of Manufacturing Engineers, 1990.

* cited by examiner

FORMING METHOD OF METAL MEMBER EXCELLENT IN SHAPE FREEZING PROPERTY

This application is a national stage application of International Application No. PCT/JP2011/061720, filed May 23, 2011, which claims priority to Japanese Application No. 2010-119158, filed May 25, 2010, which is incorporated by reference in its entirety.

TECHNICAL FIELD

The present invention relates to a forming method that improves the shape freezing property of a metal member such as a hat-shaped cross section member having a bent portion in its longitudinal direction that is used for a structure member of an automobile vehicle body, for example.

BACKGROUND ART

In recent years, there has been often used a member whose cross section perpendicular to its longitudinal direction has a hat shape, (which will be called a hat-shaped cross section member hereinafter), for a structure member of an automobile vehicle body. A hat-shaped cross section member 1 is formed and worked into a shape depicted in FIG. 1, for example, and has a bent portion 2 bent in its longitudinal direction with flange portions positioned outside.

In the case when the hat-shaped cross section member is formed and worked so as to have the bent portion 2 as above, springback ascribable to residual stress occurs, and as indicated by a dotted line in FIG. 2, hanging down in three-dimensional directions occurs in the longitudinal direction based on the bending point. The correction of this hang-down shape cannot be conducted by the correction of springback in a conventional two-dimensional shape (an opening of a U-shaped cross section in a cross section taken along I-I in FIG. 1). Note that an amount of springback is defined to be the value of an amount of hang down in the vertical direction from the desired shape of a tip portion of a product.

As above, in the forming of the hat-shaped cross section member, securing the shape freezing property is a very important technical challenge.

CITATION LIST

Patent Literature

Patent Literature 1: Japanese Laid-open Patent Publication No. 2004-181502

Patent Literature 2: Japanese Laid-open Patent Publication No. 2007-21568

SUMMARY OF INVENTION

Solution to Problem

In order to secure the shape freezing property, in Patent Literature 1, for example, there has been proposed a working method in which by using a punch having a projecting portion that projects toward a metal sheet and has a semicircular-shaped cross section in its head portion, the projecting portion of the punch is brought into contact with the portion of the metal sheet to be a wall portion of a hat-shaped cross section to perform a preliminary work in which the portion, of the metal sheet, to be a hat head portion is formed into a projecting shape projecting outward, and next to perform a finishing work by using a punch for obtaining a predetermined hat shape. However, this working method is a working method for a hat-shaped cross section member having a certain shape in an axial longitudinal direction, and further is a technique that is applicable only to a two-dimensional warp and is not applicable to the improvement of the hanging down in the three-dimensional shape in the longitudinal direction of the hat-shaped cross section member 1 having the bent portion 2 bent in the longitudinal direction with the flange portions positioned outside as depicted in FIG. 1 and FIG. 2.

Further, in Patent Literature 2, for example, as for the forming method of the hat-shaped cross section member having the bent portion in the longitudinal direction of the member, there has been proposed a forming method of a hat-shaped cross section member excellent in three-dimensional shape freezing property, in which by using working tools of a dice, a punch, and a blank holder, in the first stage forming, the above-described member is formed so that a radius r (mm) of a punch shoulder becomes larger than a radius R (mm) of a shoulder of a product, and in the second stage forming, the above-described member is formed so as to have the same width as that in the first stage forming and to have the radius R (mm) of the shoulder of the product. However, this forming method is a forming method for a hat-shaped cross section member bent in the longitudinal direction with flange portions positioned inside, and is a technique that is not applicable to the improvement of the hanging down in the three-dimensional shape in the longitudinal direction of the hat-shaped cross section member 1 having the bent portion 2 bent in the longitudinal direction with the flange portions positioned outside as depicted in FIG. 1 and FIG. 2.

As above, there has been a growing need for improving the shape freezing property of the hat-shaped cross section member 1 having the bent portion 2 bent in the longitudinal direction with the flange portions positioned outside, but no proposition to improve this has been made currently.

The present invention has been made in consideration of the above-described challenge, and has an object to provide a forming method that improves the shape freezing property of a metal member having, on its cross section perpendicular to its longitudinal direction, vertical wall portions on both sides and flange portions connected to at least one of the vertical wall portions on both sides, and having a bent portion bent in the longitudinal direction with the flange portions positioned outside.

Solution to Problem

A forming method of a metal member excellent in shape freezing property of the present invention being a method of forming a metal member having, on its cross section perpendicular to its longitudinal direction, vertical wall portions on both sides and flange portions connected to at least one of the vertical wall portions on both sides, and having a bent portion bent in the longitudinal direction with the flange portions positioned outside by using punches and dices, the forming method includes:

setting a dice shoulder radius of the dice for obtaining a final shape of the metal member to $R_0$, forming the metal member one time or a plurality of times by the dice having a dice shoulder radius $R_1$ larger than the dice shoulder radius $R_0$, and then forming the metal member by the dice having the dice shoulder radius $R_0$.

Further, another characteristic of the forming method of the metal member excellent in shape freezing property of the present invention lies in the point that the dice shoulder radius $R_1$ is set to fall within a range of not less than $1.1R_0$ nor more than $3.5R_0$.

Further, another characteristic of the forming method of the metal member excellent in shape freezing property of the present invention lies in the point that the metal member has, on its cross section perpendicular to its longitudinal direction, vertical wall portions on both sides, flange portions connected to at least one of the vertical wall portions on both sides, and a top sheet portion connected to the vertical wall portions, and has a bent portion bent in the longitudinal direction with the flange portions positioned outside.

Further, another characteristic of the forming method of the metal member excellent in shape freezing property of the present invention lies in the point that the metal member is a hat-shaped cross section member.

Advantageous Effects of Invention

According to the present invention, in a metal member having, on its cross section perpendicular to its longitudinal direction, vertical wall portions on both sides and flange portions connected to at least one of the vertical wall portions on both sides, and having a bent portion bent in the longitudinal direction with the flange portions positioned outside, it is possible to drastically decrease hanging down caused by springback in the longitudinal direction and improve the shape freezing property.

DESCRIPTION OF EMBODIMENTS

Hereinafter, a preferred embodiment of the present invention will be explained with reference to the attached drawings.

Figure 1:
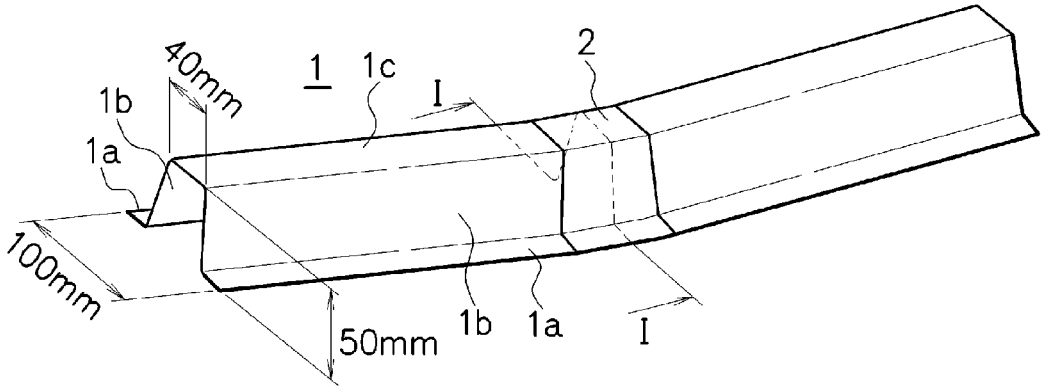
FIG. 1 is a view depicting a product shape of a hat-shaped cross section member.
Figure 2:
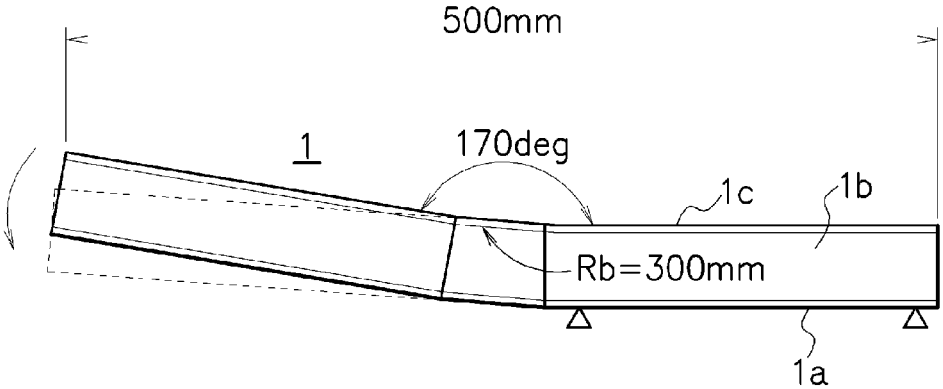
FIG. 2 is a view depicting a state of springback after the hat-shaped cross section member is formed.

A hat-shaped cross section member 1 being a metal member formed by this embodiment is formed and worked into a shape depicted in FIG. 1. That is, the hat-shaped cross section member 1 has, on its cross section perpendicular to its longitudinal direction (for example, a cross section taken along I-I), vertical wall portions 1*b* and 1*b* on both sides, flange portions 1*a* and 1*a* on both sides connected to the respective vertical wall portions 1*b* and 1*b*, and a top sheet portion 1*c* connected to the vertical wall portions 1*b* and 1*b* on both sides, and has a bent portion 2 bent in the longitudinal direction with the flange portions 1*a* and 1*a* positioned outside, in other words, with the top sheet portion 1*c* positioned inside.

Figure 3:
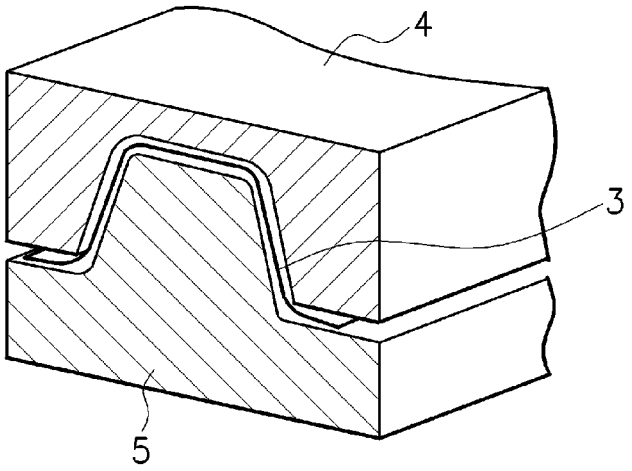
FIG. 3 is a view depicting working tools for forming the hat-shaped cross section member.

In the case when the hat-shaped cross section member 1 as above is formed, as depicted in FIG. 3, by using working tools including a punch 5, a dice 4, and a not-depicted blank holder as necessary, a steel sheet 3 is formed and worked.

Figure 4A:
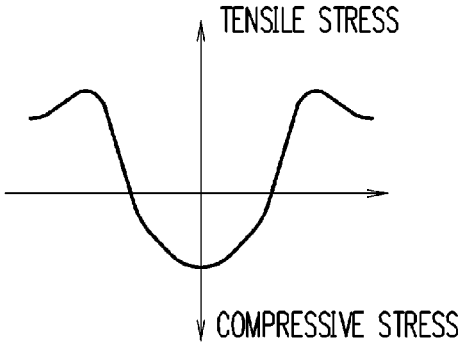
FIG. 4A is a view depicting distribution of stress causing springback in forming of the hat-shaped cross section member on a cross section taken along I-I in FIG. 1 by a conventional forming method.

FIG. 4A is a view depicting distribution of stress causing springback in forming of the hat-shaped cross section member on the cross section taken along I-I in FIG. 1 by a conventional forming method, namely by press forming one time. In the conventional forming, as depicted in FIG. 4A, large tensile stress occurs in the flange portions 1*a* and 1*a* of the bent portion 2 mainly, and further large compressive stress occurs in a punch bottom (the top sheet portion 1*c*) of the bent portion 2. These tensile-compressive stresses become driving force, and thereby large hanging down of a product in the longitudinal direction that starts from the bent portion 2 occurs, and thus the shape accuracy of the product deteriorates.

Figure 5:
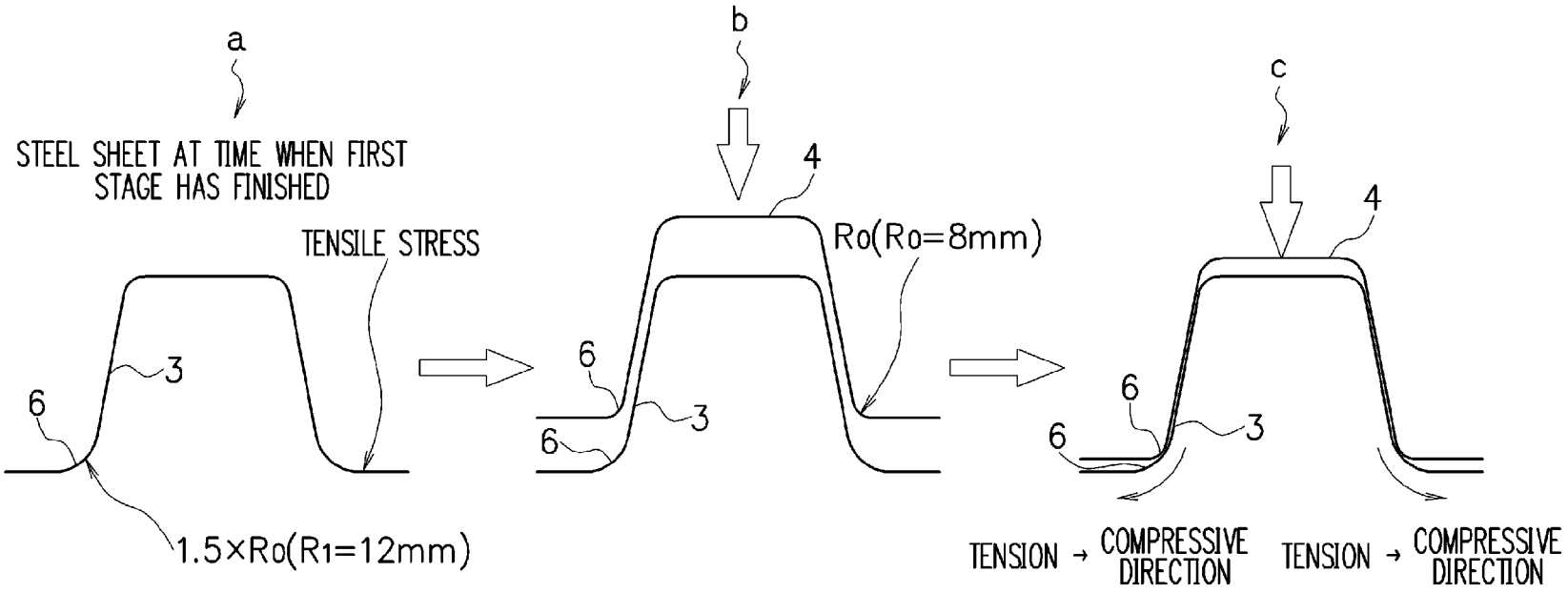
FIG. 5 is a view depicting a forming state on the cross section taken, along I-I in FIG. 1 in the forming method of the hat-shaped cross section member of this embodiment.
Figure 6:
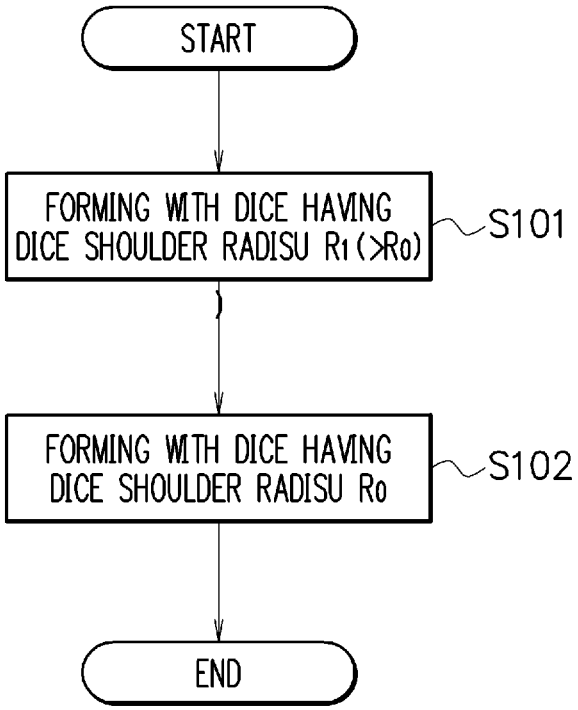
FIG. 6 is a flowchart depicting a procedure of the forming method of the hat-shaped cross section member of this embodiment.

Thus, the present inventor conducted a diligent examination in order to minimize the balance of the above-described tensile-compressive stresses, and as depicted in FIG. 5, devised to perform press forming at two stages. FIG. 5 is a view depicting a forming state on the cross section taken along I-I in FIG. 1 in a forming method of a hat-shaped cross section member of this embodiment. Incidentally, in FIG. 5, the reference numerals 6 denote a dice shoulder of the dice 4 and a dice shoulder of the steel sheet 3. Further, FIG. 6 is a flowchart depicting a procedure of the forming method of the hat-shaped cross section member of this embodiment.

A dice shoulder radius of the dice 4 for obtaining the final shape is set to $R_0$ [mm]. In the forming at the first stage, the hat-shaped cross section member is formed by the dice 4 having a dice shoulder radius $R_1$ [mm] larger than the dice shoulder radius $R_0$ [mm] (Step S101) to make only the tensile stress act in the flange portions 1*a* and 1*a* of the bent portion 2. The state a in FIG. 5 depicts the steel sheet 3 at the time when the first stage has finished. The dice shoulder radius $R_1$ is preferably set to fall within a range of not less than $1.1R_0$ nor more than $3.5R_0$. The reason why the dice shoulder radius $R_1$ is set to $3.5R_0$ or less is because if the dice shoulder radius $R_1$ is too large, wrinkles tend to be formed on a formed article easily.

Next, in the forming at the second stage, as depicted in the state b and the state c in FIG. 5, by the dice 4 having the dice shoulder radius $R_0$ [mm], the hat-shaped cross section member is formed into the final shape (Step S102).

The punch width at the first stage and the punch width at the second stage are both set to the same. Further, in the forming at the first stage, the dice shoulder radius $R_1$ is desirably applied to the entire area in the longitudinal direction of the hat-shaped cross section member including the bent portion 2, but the dice shoulder radius $R_1$ can also be applied to part of the hat-shaped cross section member, for example, only the vicinity of the bent portion 2.

Figure 4B:
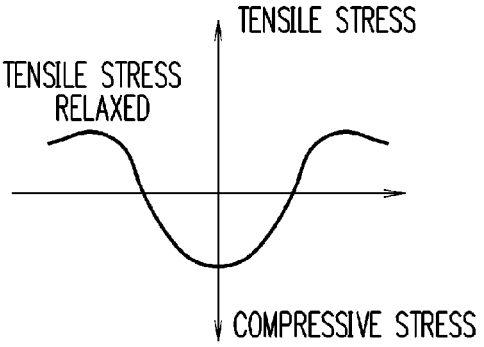
FIG. 4B is a view depicting distribution of stress causing springback in forming of the hat-shaped cross section member on the cross section taken along I-I in FIG. 1 by a forming method of a hat-shaped cross section member of an embodiment.

FIG. 4B is a view depicting distribution of stress causing springback in the forming of the hat-shaped cross section member on the cross section taken along I-I in FIG. 1 according to the forming method of the hat-shaped cross section member of this embodiment. By performing the press forming at two stages, the tensile stress in the flange portions 1*a* and 1*a* of the bent portion 2 is extremely decreased as compared to the tensile stress in the flange portions 1*a* and 1*a* depicted in FIG. 4A, and in the final shape, the stress relaxed in a compressing direction acts in the flange portions 1*a* and 1*a*, and thereby the balance of the tensile-compressive stresses can be minimized. By applying the forming method as above, the tensile stress to occur in the flange portions 1*a* and 1*a* of the bent portion 2 can be corrected in the compressing direction, and hanging down caused by springback in the longitudinal direction can be decreased drastically.

Example

As depicted in FIG. 1, the hat-shaped cross section member 1 having a length of 500 [mm], a hat head portion width (a top sheet portion width) of 40 [mm], a width between edges of the flange portions 1*a* and 1*a* of 100 [mm], and a vertical wall portion length of 50 [mm] was formed and worked so as to have the bent portion 2 having a radius Rb: 300 [mm] (a bending angle: about 170 [°]) in the middle portion in the longitudinal direction.

In a present invention example, in the forming at the first stage depicted in the state a in FIG. 5, the hat-shaped cross section member 1 was formed larger with the dice shoulder radius $R_1$ [mm] of the bent portion 2 set to $1.25R_0$: 10 [mm] being 1.25 times the dice shoulder radius $R_0$: 8 [mm] to make the tensile stress act in the flange portions 1*a* and 1*a*. Next, as depicted in the state b in FIG. 5, the punch width was set to the same as that at the first stage, and by using the dice 4 having the dice shoulder radius $R_0$: 8 [mm], the hat-shaped cross section member 1 was formed and worked to correct the tensile stress to occur in the flange portions 1*a* and 1*a* in the compressing direction.

Similarly, in another present invention example, in the forming at the first stage depicted in the state a in FIG. 5, the hat-shaped cross section member 1 was formed larger with the dice shoulder radius $R_1$ [mm] of the bent portion 2 set to $1.5R_0$: 12 [mm] being 1.5 times the dice shoulder radius $R_0$: 8 [mm] to make the tensile stress act in the flange portions 1*a* and 1*a*. Next, as depicted in the state b in FIG. 5, the punch width was set to the same as that at the first stage, and by using the dice 4 having the dice shoulder radius $R_0$: 8 [mm], the hat-shaped cross section member 1 was formed and worked to correct the tensile stress to occur in the flange portions 1*a* and 1*a* in the compressing direction.

On the other hand, as a comparative example, by using the dice 4 having a dice shoulder radius R: 8 [mm], the hat-shaped cross section member was formed and worked at the single stage as directed by the conventional method.

Figure 7:
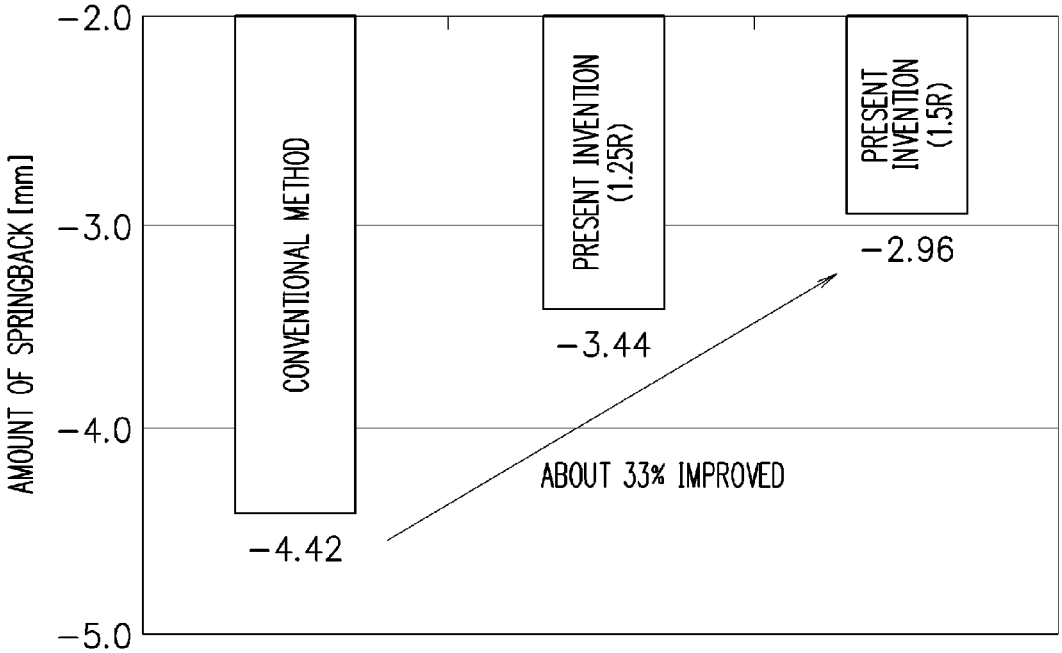
FIG. 7 is a view depicting an effect of which springback is improved by examples.

As a result, as depicted in FIG. 7, in the comparative example, the amount of springback reached up to about 4.42 [mm], which was extremely large. In contrast to this, in the present invention example in which the dice shoulder radius $R_1$ [mm] of the bent portion 2 was set to $1.5R_0$: 12 [mm] in the forming at the first stage, the amount of springback became about 2.96 [mm], and a surprising effect of which the amount of springback was improved by up to about 33% was able to be achieved.

In Table 1, the relationship between the ratio of the dice shoulder radii $R_1/R_0$ and the amount of springback is depicted. As depicted in Table 1, as compared to the case of $R_1/R_0=1$, namely the case of the hat-shaped cross section member being formed and worked at the single stage as indicated by the conventional method, by increasing $R_1/R_0$, the amount of springback was able to be decreased. The more $R_1/R_0$ was increased, the less the amount of springback became, but when the dice shoulder radius $R_1$ being in excess of $3.5R_0$ as is in the case of $R_1/R_0=3.8$, poor forming occurred.

TABLE 1

| $R_1/R_0$ | AMOUNT OF SPRINGBACK [mm] | NOTE |
|---|---|---|
| 1.0 | −4.42 | CONVENTIONAL METHOD |
| 1.1 | −3.8 | RECOMMENDED VALUE LOWER LIMIT |
| 1.5 | −2.96 | |
| 2.0 | −2.8 | |
| 2.5 | −2.74 | |
| 3.0 | −2.72 | |
| 3.5 | −2.71 | RECOMMENDED VALUE UPPER LIMIT |
| 3.8 | — | POOR FORMING OCURRED |

In the foregoing, the present invention has been explained with various embodiments, but the present invention is not limited only to these embodiments and may be changed within the scope of the present invention. For example, in the above-described embodiment, the example where the press forming was performed at the two stages has been explained, but the press forming may also be performed at three stages or more. That is, the hat-shaped cross section member 1 is formed a plurality of times by the dice having the dice shoulder radius $R_1$ larger than the dice shoulder radius $R_0$. In this case, the dice shoulder radius $R_1$ is gradually decreased within a range where the dice shoulder radius $R_1$ does not become smaller than the dice shoulder radius $R_0$. Thereafter, the hat-shaped cross section member 1 is formed by the dice having the dice shoulder radius $R_0$.

Further, in the above-described embodiment, the example where the bent portion 2 was bent in the vertical direction with the flange portions 1*a* and 1*a* positioned outside (namely the top sheet portion 1*c* positioned inside) has been explained, but the present invention is applicable also to the case when the bent portion 2 is bent obliquely upward with the top sheet portion 1*c* positioned inside. That is, the present invention is applicable to the case when the bent portion 2 is bent so as to contain the component in the vertical direction with the top sheet portion 1*c* positioned inside.

Figure 8A:
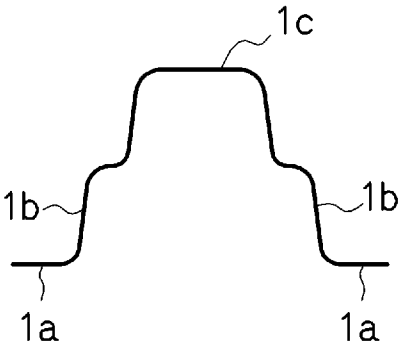
FIG. 8A is a view depicting an example of a metal member to which the present invention is applicable.
Figure 8B:
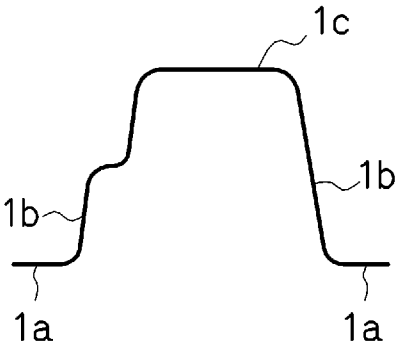
FIG. 8B is a view depicting an example of the metal member to which the present invention is applicable.
Figure 8C:
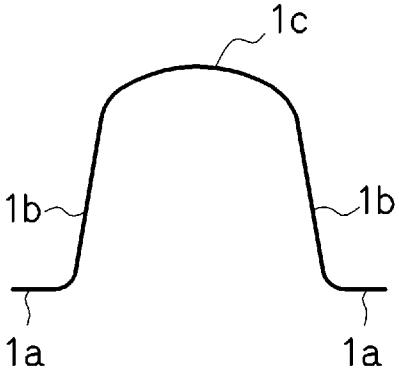
FIG. 8C is a view depicting an example of the metal member to which the present invention is applicable.

Further, in the above-described embodiment, the member whose cross section perpendicular to the longitudinal direction has the hat shape with a single step has been explained as an example, but the present invention is applicable also to metal members whose cross section perpendicular to the longitudinal direction each have a hat shape with multiple steps depicted in FIG. 8A and FIG. 8B, for example. Further, the present invention is applicable also to a metal member having a shape such that the vertical wall portions 1*b* and 1*b* on both sides and the top sheet portion 1*c* are smoothly connected on the cross section perpendicular to the longitudinal direction depicted in FIG. 8C, for example.

INDUSTRIAL APPLICABILITY

The present invention makes it possible to drastically decrease hanging down caused by springback in the longitudinal direction in a metal member having, on its cross section perpendicular to its longitudinal direction, vertical wall portions and flange portions connected to the above-described vertical wall portions, and having a bent portion bent in the longitudinal direction with the above-described flange portions positioned outside, such as a hat-shaped cross section member used for a structure member of an automobile vehicle body, for example.

The invention claimed is:

1. A forming method of a metal member, excellent in shape freezing property, being a method of forming the metal member having, on its cross section perpendicular to its longitudinal direction, vertical wall portions on both sides and flange portions connected to at least one of the vertical wall portions on both sides, and having a bent portion bent in the longitudinal direction with the flange portions positioned outside, by using punches and dices, the forming method comprising:

setting a dice shoulder radius of the dice for obtaining a final shape of the metal member to $R_0$, forming an intermediate shape having, on its cross section perpendicular to its longitudinal direction, vertical wall portions on both sides and flange portions connected to at least one of the vertical wall portions on both sides, and having a bent portion bent in the longitudinal direction with the flange portions positioned outside by forming the metal member one time or a plurality of times by the dice having a dice shoulder radius $R_1$ larger than the dice shoulder radius $R_0$, and then forming the final shape by forming the metal member by the dice having the dice shoulder radius $R_0$;

wherein a dice shoulder corresponds to a portion where the vertical wall portions and the flange portions are connected; and wherein the dice shoulder radius $R_1$ is set to fall within a range of not less than $1.1R_0$ nor more than $3.5R_0$.

2. The forming method of the metal member according to claim 1, wherein the metal member has, on its cross section perpendicular to its longitudinal direction, vertical wall portions on both sides, flange portions connected to at least one of the vertical wall portions on both sides, and a top sheet portion connected to the vertical wall portions, and has a bent portion bent in the longitudinal direction with the flange portions positioned outside.

3. The forming method of the metal member according to claim 2, wherein the metal member is a hat-shaped cross section member.

* * * * *